United States Patent [19]

Kirby et al.

[11] Patent Number: 4,791,812

[45] Date of Patent: Dec. 20, 1988

[54] YARN INSPECTION SYSTEM

[75] Inventors: Robert A. Kirby, Columbia; Clifton L. Davis, Lugoff, both of S.C.

[73] Assignee: Allied-Signal Inc., Morris Township, Morris County, N.J.

[21] Appl. No.: 530,331

[22] Filed: Sep. 8, 1983

[51] Int. Cl.[4] ..... G01L 5/04

[52] U.S. Cl. ..... 73/160; 28/172; 28/187

[58] Field of Search ..... 73/160; 28/172, 187; 57/80, 81, 352; 242/147 R, 153, 154; 68/DIG. 4; 100/47; 226/180–183, 186, 187; 474/101–103

[56] References Cited

U.S. PATENT DOCUMENTS

| | | | |
|---|---|---|---|
| 2,206,469 | 7/1940 | Peterson et al. | 68/DIG. 4 |
| 2,636,951 | 4/1953 | Fahringer | 73/160 |
| 3,058,343 | 10/1962 | Hutchens et al. | 73/160 |
| 3,386,145 | 6/1968 | Harris | 73/160 |
| 3,513,966 | 5/1970 | Eckels | 474/103 |
| 3,793,883 | 2/1974 | Goldfarb et al. | 73/160 |
| 3,827,296 | 8/1974 | Hidaka | 73/160 |
| 3,902,234 | 9/1975 | Fernandes | 68/6 |
| 4,010,915 | 3/1977 | Strutz et al. | 242/147 R |
| 4,039,609 | 8/1977 | Thiel et al. | 264/210.5 |
| 4,094,452 | 6/1978 | Makela | 226/186 |

*Primary Examiner*—Allan N. Shoap
*Assistant Examiner*—W. Morris Worth

[57] ABSTRACT

A yarn inspection system which comprises a source of yarn, a defect detector and a take-up stand is provided with the following features. A yarn path extender is located between the detector and the take-up stand and comprises a plurality of rolls each having a yarn contacting surface finish of about 40 to 100 RMS; the longitudinal axes of the rolls are approximately parallel, and the rolls are positioned so that the yarn path about the rolls is sinuous. The take-up stand comprises at least two rolls, at least one of which is driven by a motor, with each of the rolls being positioned for contact with at least one other roll while the yarn passes therebetween when the system is operational. A switch, normally closed when the rolls are positioned for contact with a least one other roll, opens when the rolls are displaced to thereby stop the driving motor.

12 Claims, 4 Drawing Sheets

YARN INSPECTION SYSTEM

BACKGROUND OF THE INVENTION

1. Field of the Invention

The present invention relates to a yarn inspection system for the rapid development of yarn quality data, and more particularly, to a system which permits immediate testing of yarns after spinning to permit identification of problem spin positions and establishment of process trends.

2. The Prior Art

There are many processes for producing yarns; most involve a spinning step followed by other steps either on a continuous (coupled) or discontinuous (uncoupled) basis. Prior to a yarn end combining step, it is desirable to have feedback on yarn quality so that problem spinning positions can be isolated. This feedback parallel of a plurality of yarn ends on a cylindrical beam, which may occur as much as several days after spinning.

SUMMARY OF THE INVENTION

The present invention provides an improvement in a yarn inspection system which comprises a source of yarn, a defect detector and a take-up stand. The improvement comprises a yarn path extender located between the detector and the take-up stand and comprising a plurality of, preferably three, extender rolls. Each of the extender rolls has a yarn contacting surface finish of about 40 to 100 RMS, more preferably 40 to 70 RMS, most preferably 60 to 70 RMS. The extender rolls are positioned so that their longitudinal axes are approximately parallel, and the yarn path about the extender rolls is sinuous.

An improvement in a system, which additionally comprises a yarn repository, is also provided. Here, the take-up stand comprises at least two rolls, at least one of which is driven by a motor. Each of the rolls is positioned for contact with at least one other roll with the yarn passing therebetween when the system is operational. The rolls are displaceable. The improvement comprises a switch, normally closed when the rolls are positioned for contact with at least one other roll. The switch opens when the rolls are displaced to stop driving of the motor. Opening of the switch by roll displacement preferably also activates an electromechanical friction brake on the motor to assist in stopping.

It is also preferred that the system additionally comprise roll displacement means. The roll displacement means comprises a first pivot arm connected to one of the rolls (of the take-up stand) and to a lift cylinder which may be pneumatically, hydraulically or electrically caused to retract by a switch. It is preferred that this cylinder be an air lift cylinder actuated by an air switch. Retraction of the lift cylinder causes the first pivot arm to rotate and thus displace the roll to which it is connected. Most preferably, the take-up stand comprises three rolls with the first pivot arm being connected to the roll most remote from the initial yarn contact roll. In this instance, the roll displacement means preferably also comprises a second pivot arm connected to the intermediate roll and to the first pivot arm, rotation of the first pivot arm causing the second pivot arm to rotate and thus displace the roll to which it is connected. It is also preferred that at least one of the pivot arms have a pin thereon which engages a slot in a plate also forming part of the take-up stand when the first pivot arm is rotated to displace the roll.

Most preferably, the yarn path extender, switch and roll displacement means are all used together to form the improved yarn inspection system of the present invention.

The temm "RMS," which is an abbreviation of root-mean-square, is an arbitrary measurement of surface texture and is described in detail in the publication, Surface Texture (ASA B 46.1-1962), The American Society of Mechanical Engineerings, United Engineering Center, 345 E. 47th Street, New York 17, N.Y., page 16 (1962).

BRIEF DESCRIPTION OF THE DRAWINGS

In the accompanying drawings.

DESCRIPTION OF THE PREFERRED EMBODIMENT

Figure 1:
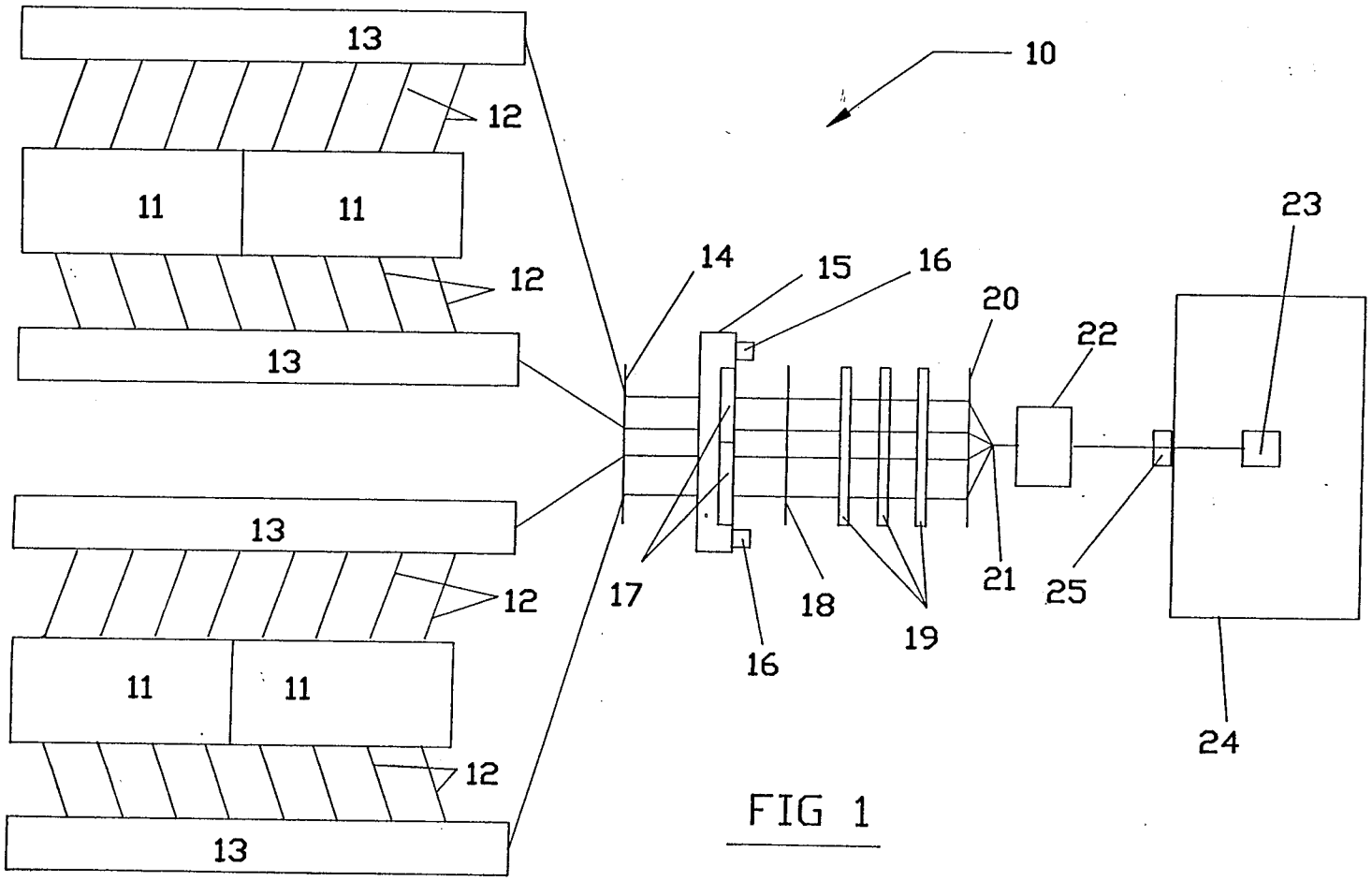
FIG. 1 is a schematic plan view of the yarn inspection system 10 of the present invention.

With reference to FIG. 1, a yarn source is provided by buggies 11, four in number. Each of the buggies holds thirty-two yarn packages doffed from a spinning machine. A yarn end 12 from each package (unshown) is led from buggy 11 to a tension bracket, eyelet guide and drop wire (all unshown), held by poles that are mounted on base 13. The tension guide is a left or right hand Kidde tension bracket number 156224 with 135° angle from entry to exit. From the drop wires (unshown) yarn ends 12 pass to eyelet board 14, in four groups of thirty-two, downstream of which they travel as a yarn sheet to Lindly yarn inspector 15 (model 2060-ECU), and thence through second eyelet board 18, yarn path extender 19, third eyelet board 20 after which the yarn sheet is converged to a tow at pigtail guide 21 and passes through take-up stand 22, from which it travels to yarn repository 23 which is an enclosed waste bin with apirator and accompanying muffler 25. There are two brackets 16 screwed onto the downstream side of defect detector 15 on opposing sides of the yarn sheet. A bar 17 is held in place by a set screw in each bracket above defect detector 15. The two bars 17 are shown mounted end to end although they may be separated. If an abnormally high number of defects is observed by defect detector 15 during operation, these bars 17, or yarn bridge, function to hold any number of desired yarn ends 12 up and out of the scan of the defect detector 15. By changing the ends 12 scanned, problem packages can be isolated more quickly.

Figure 2A:
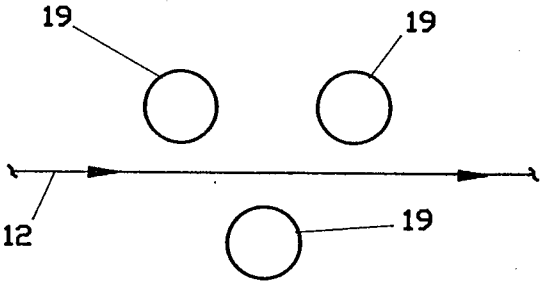
FIGS. 2A and 2B are schematic front views of, respectively, yarn path extender 19 in its inoperative and operative position.
Figure 2B:
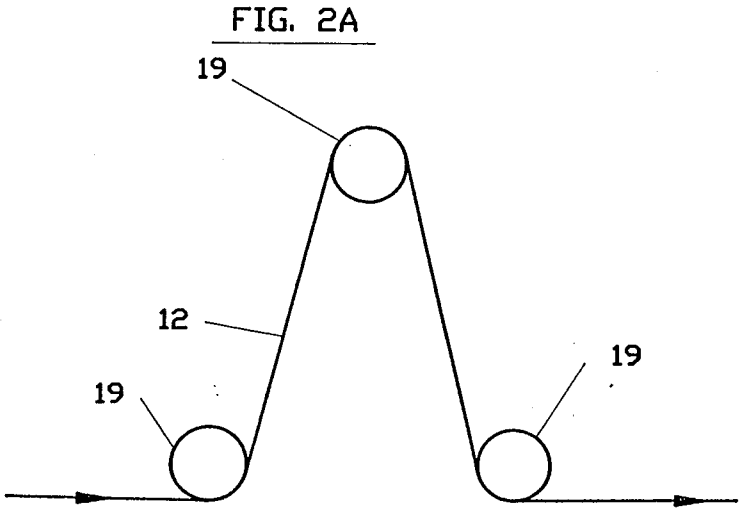
Figure 4:
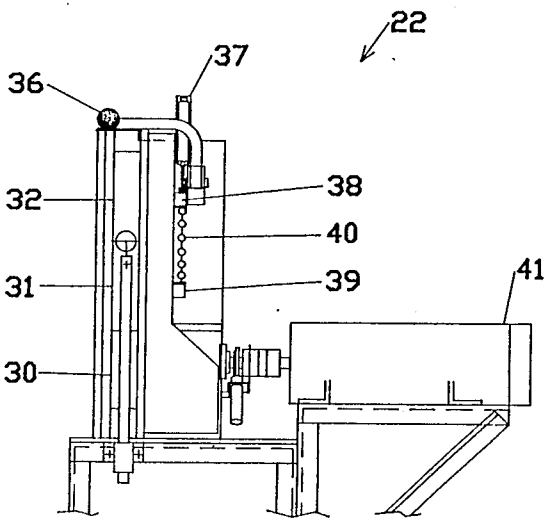
FIG. 4 is a downstream side view of take-up stand 22.
Figure 3:
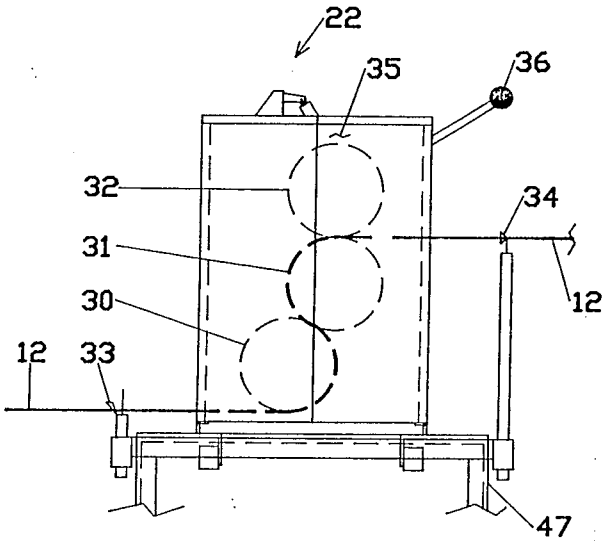
FIG. 3 is a front viewoof take-up stand 22 with its door 35 closed.

FIGS. 2A and 2B show the yarn path extender in its inoperative add operative positions, respectively. The device functions to add additional length to the path of the yarn sheet to permit defects detected by detector 15 to be located prior to convergence of the yarn sheet into a tow at guide 21. Use of the yarn path extender permits utilization of as little floor space as possible with high speed travel of the yarn sheet, i.e., as fast as 1500 yards per minute (8000 rpm). The yarn path extender comprises a plurality of rolls 19 which are positioned so that their longitudinal axes are approximately parallel and the yarn path about the rolls 19 is sinuous when operative, as shown in FIG. 2B. The inoperative position is shown in FIG. 2A with the rolls simply located on either side of the sheet of yarn ends 12 without contacting the sheet. A post assembly (unshown) on either side of the yarn sheet has a collar attached on each side via a T bolt (unshown). Each pair of collars may hold one or more rolls 19. The position of rolls 19 can be readily changed by moving the collar and T bolt vertically on the post assembly. It is preferred for the embodiment shown in FIGS. 2A and 2B that the center roll 19 be mounted on one collar while the other two rolls are mounted on another collar. For the center roll, it is preferred that the collar be mounted on the post assembly above the collar for the other two rolls; to achieve this, particularly with reference to the inoperative position wherein the yarn sheet passes between the rolls without contacting them, the collars holding the center roll have a dropped leg in which the roll sits. Furthermore, the surface finish of roll 19 is critical to proper operation. The finish must be in the 40 to 100 RMS range, more preferably 40 to 70 RMS, most preferably 60 to 70 RMS. With a smooth finish, tension is so high that the yarn being examined wraps on the rolls. With the 60 to 70 RMS surface finish, the rolls will spin against the yarn when the sheet is stopped. It is preferred that the rolls 19 be freewheeling and that the center roll be set three feet above the outer rolls.

With reference to FIGS. 3 through 6, take-up stand 22 and its operation will now be described. Take-up stand 22 comprises three rolls 30, 31 and 32. Roll 30 is driven by motor 41, and is formed of chrome-plated carbon steel. Rolls 31 and 32 are freewheeling urethane-coated carbon steel rolls. The sheet of yarn ends 12 passes in a S curve through yarn guide 33 under roll 30 between rolls 30 and 31, then up and between rolls 31 and 32 and through guide 34 for exit. It is desired that take-up stand 22 operate at yarn speeds of 1500 yards per minute. To achieve this, roll 30 has an outer diameter of approximately 9.8 inches and a yarn contacting surface of approximately three inch width.

Take-up stand 22 is equipped with a system to provide separation of rolls 32, 31 and 30 for string-up. As stated previously, rolls 31 and 32 are freewheeling rolls mounted to, respectively, pivot arms 39 and 38. Pivot arms 39 and 38 have their pivot point in the frame of the take-up stand (see FIG. 5). Actuation of air lift cylinder 37 (Humphrey Model 5-DP-2) is by air switch 47, which is manually operated. Air switch 47 causes cylinder 37 to retract. Air cylinder 37 is attached to first pivot arm 38 which rotates clockwise (reference FIG. 5), to raise roll 32 when cylinder 37 retracts. First pivot arm 38 is connected to second pivot arm 39 by chain 40. Chain 40 has some slack so that top roll 32 can be lifted (displaced) about an inch and middle roll 31 about one-half inch; this provides about one-half inch clearance between bottom roll 30 and middle roll 31, and between middle roll 31 and top roll 32.

If air supply cylinder 37 were to fail while rolls 30, 31 and 32 are open for string-up, the operator's fingers could be mashed. To prevent this, a mechanical latch is provided, reference FIG. 6. There, plate 45 with slot 44 is pivotally mounted to a bracket attached to the frame. First pivot arm 38 has a pin 43 thereon which automatically engages slot 44 in plate 45 when rolls 30, 31 and 32 are separated. Pin 43 remains engaged at slot 44 until the operator raises arm 36 and reverses air switch 47.

Figure 6:
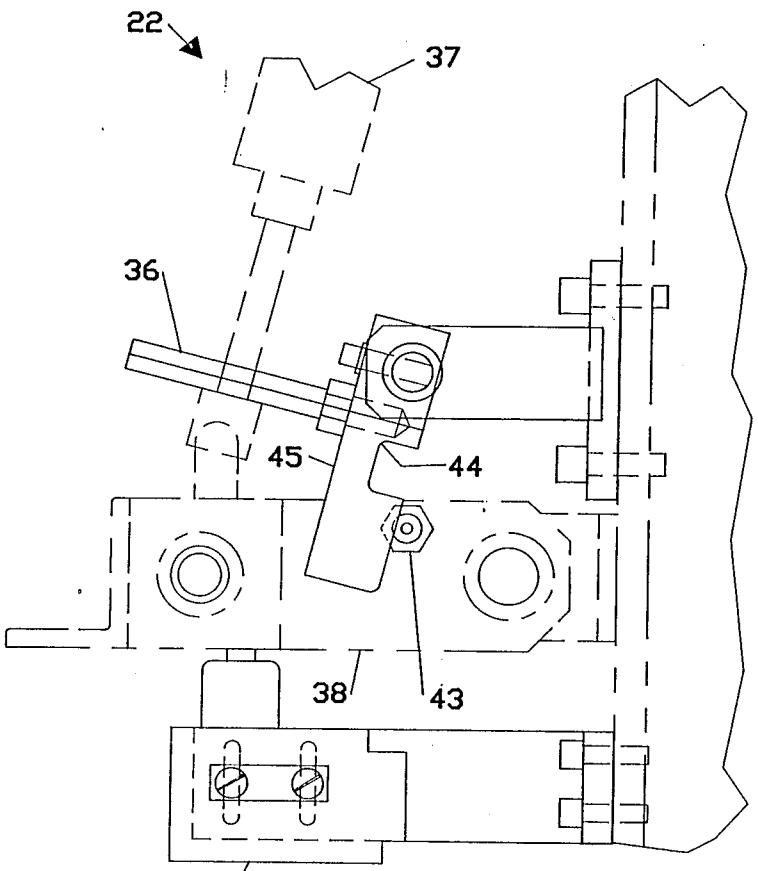
FIG. 6 shows in detail a portion of FIG. 5.
Figure 5:
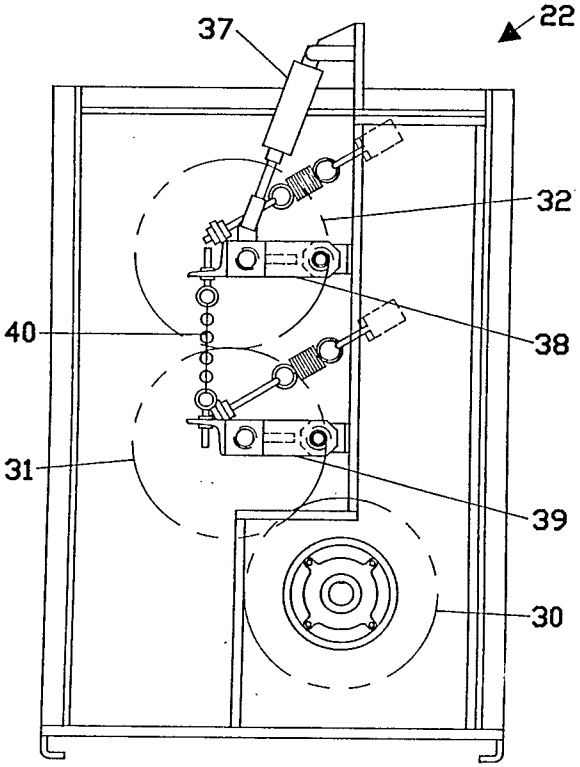
FIG. 5 is a rear view of take-up stand 22.

The take-up stand 22 of the present invention has been designed so that a wrap on any one of rolls 30, 31 or 32 will result in stopping the motor 41. With reference to FIG. 6, microswitch 46 (Microswitch Model DTE6-2RN) is mounted so that when rolls 30, 31 and 32 are closed in their operative position, first pivot arm 38 rests on (closes) switch 46. The drive is wired so that the switch must be closed for the drive to run. If switch 46 is opened, for example, by a building wrap between rolls 30 and 31 or between rolls 31 and 32, switch 46 will open and the drive will stop; furthermore, a friction brake on motor 41 will be actuated simultaneously. A wrap on any one of rolls 30, 31 or 32 will cause pivot arm 38 to rise, thereby opening switch 46.

Figure 7:
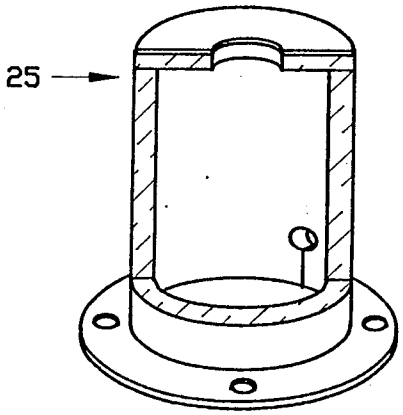
FIG. 7 shows muffler 25 without its cover.

The tow of yarn leaving guide 34 associated with take-up stand 22 is aspirated to waste bin 23 in container 24. A muffler 25 (see FIG. 7) is provided for and contains the aspirator. The muffler 25 comprises a split housing held together by a piano hinge on one side and internally lined with sound absorbing material, e.g., one inch Armor-flex insulation. Plastic tubing leads from the aspirator exit into bin 23.

The present system provides rapid identification of problem spin positions.

We claim:

1. In a yarn inspection system comprising a source of yarn, a defect detector, and a take-up stand, said source of yarn comprising multiple yarn packages, whereby during operation of said system yarn from said packages travels a yarn path as a yarn sheet past said detector, thence is converged to tow and passes through said take-up stand, the improvement comprising: a yarn path extender located between said detector and said take-up stand prior to the point said yarn is converged to tow, said extender comprising a plurality of extender rolls having a yarn contacting surface finish of about 40 to 100 RMS, said extender rolls being positioned so that their longitudinal axes are approximately parallel and the yarn path about the extender rolls is sinuous.

2. The system of claim 1 wherein the yarn contacting surface finish is about 40 to 70 RMS.

3. The system of claim 1 wherein the yarn contacting surface finish is about 60 to 70 RMS.

4. The system of claim 1 wherein the number of extender rolls is 3 with each extender roll being displaced approximately three feet from its next adjacent extender roll in the yarn path.

5. The system of claim 4 wherein the yarn contacting surface finish is about 60 to 70 RMS.

6. In a yarn inspection system, comprising a source of yarn; a defect detector; a take-up stand; and a yarn repository; said source of yarn comprising multiple yarn packages, whereby during operation of said system yarn from said packages travels a yarn path as a yarn sheet past said detector, thence is converged to tow and passes through said take-up stand to said yarn repository; the improvement comprising:

said take-up stand comprising a first roll, a second roll adjacent to said first roll, and a third roll adjacent to said second roll and remote from said first roll, at least one of said rolls being driven by a motor, each of said rolls being positioned for contact with any roll adjacent thereto with said yarn passing therebetween when said system is operational, said rolls being displaceable; and a switch, said switch being closed when said rolls are positioned for contact with at least one other roll, said switch opening when said rolls are displaced to stop the driving motor.

7. The system of claim 6 additionally comprising a brake on the motor which is activated when said switch opens.

8. In a yarn inspection system, comprising a source of yarn; a defect detector; a take-up stand; and a yarn repository; said source of yarn comprising multiple yarn packages, whereby during operation of said system yarn from said packages travels a yarn path as a yarn sheet past said detector, thence is converged to tow and passes through said take-up stand to said yarn repository; the improvement comprising:

said take-up stand comprising a first roll, a second roll adjacent to said first roll, and a third roll adjacent to said second roll and remote from said first roll, at least one of said rolls being driven by a motor, each of said rolls being positioned for contact with any roll adjacent thereto with said yarn passing therebetween when said system is operational, said rolls being displaceable;

roll displacement means comprising a first pivot arm connected to one of said rolls, means to rotate said first pivot arm and thus displace the roll to which it is connected, and a second pivot arm connected to a second of said rolls and to the first pivot arm, whereby rotation of said first pivot arm causes said second pivot arm to rotate and thus displace the roll to which it is connected; and a switch, said switch being closed when said rolls are positioned for contact with at least one other roll, said switch opening when said rolls are displaced to stop the driving motor.

9. The system of claim 8 wherein at least one of said pivot arms has a pin thereon and said take-up stand additionally comprises a plate with a slot therein, said pin engaging said slot when said first pivot arm is rotated to displace the roll.

10. The system of claim 6 additionally comprising a yarn path extender located between said detector and said take-up stand and comprising a plurality of extender rolls each having a yarn contacting surface finish of about 40 to 100 RMS, said extender rolls being positioned so that their longitudinal axes are approximately parallel and the yarn path about the extender rolls is sinuous.

11. The system of claim 10 wherein the yarn path extender comprises three extender rolls with each extender roll being displaced approximately three feet from its next adjacent extender roll in the yarn path.

12. The system of claim 11 wherein the yarn contacting surface finish is about 60 to 70 RMS.

* * * * *